United States Patent [19]

Kosaka et al.

[11] Patent Number: 4,630,079

[45] Date of Patent: Dec. 16, 1986

[54] PRESSURE SENSITIVE COPYING PAPER

[75] Inventors: Takao Kosaka, Himeji; Mamoru Ishiguro; Hideaki Senoh, both of Takasago, all of Japan

[73] Assignee: Mitsubishi Paper Mills, Ltd., Tokyo, Japan

[21] Appl. No.: 823,508

[22] PCT Filed: Apr. 17, 1985

[86] PCT No.: PCT/JP85/00211

§ 371 Date: Dec. 20, 1985

§ 102(e) Date: Dec. 20, 1985

[87] PCT Pub. No.: WO85/04841

PCT Pub. Date: Nov. 7, 1985

[30] Foreign Application Priority Data

Apr. 21, 1984 [JP] Japan ..... 59-80842
Dec. 21, 1984 [JP] Japan ..... 59-271500

[51] Int. Cl.[4] ..... B41M 5/22

[52] U.S. Cl. ..... 346/207; 346/215; 427/150; 427/200; 428/402.21; 428/402.22

[58] Field of Search ..... 346/205, 214, 215; 427/150–152, 200; 428/402.21, 402.22

[56] References Cited

U.S. PATENT DOCUMENTS 4,486,762 12/1984 Okamoto et al. ..... 346/207

FOREIGN PATENT DOCUMENTS 0121815 9/1979 Japan ..... 346/207

*Primary Examiner*—Bruce H. Hess
*Attorney, Agent, or Firm*—Cushman, Darby & Cushman

[57] ABSTRACT

A pressure sensitive copying paper comprising a sheet having on a support a coating layer containing finely divided cellulose powder (a) and mononucelus microcapsules (b) containing an oil solution of an electron donative colorless or light-colored dye, using an amino resin as film material and having a volume-average particle diameter of 5–10 microns (μm) and a film thickness of 0.08–0.3 microns (μm); and a sheet having on a support a coating layer containing an electron acceptant solid-state acid material which is reacted on contact with the dye to form a color. This pressure sensitive copying paper has the advantages such as excellent color forming performance, proofness against smudging, long-time storage stability, etc.

2 Claims, No Drawings

PRESSURE SENSITIVE COPYING PAPER

TECHNICAL FIELD

This invention relates to a pressure sensitive copying paper, and more particularly to a pressure sensitive copying paper excellent in color formation and proof against smearing or soiling (hereinafter referred to as smudging).

BACKGROUND ART

Pressure sensitive copying paper is basically composed of a top sheet coated on its one side with microcapsules containing an oil solution of an electron donative colorless or light-colored dye, a bottom sheet provided on its one side with a coating layer containing an electron acceptant solid-state acid material and an adhesive, and an intermediate sheet coated on its one side with a microcapsule layer and on the other side with a layer made of an electron acceptant solid-state acid material.

It often occurs that the microcapsule layer and the electron acceptant solid-state acid material coated face come into contact with each other in the course of manufacture, printing operation, preparation of books, etc. For instance, such contact occurs when the intermediate sheet is rolled up or cut, or at the time of collation of sheets. In such a case, a certain degree of pressure or frictional force is exerted to the microcapsules, and as a result, part of the microcapsules might be broken to cause abnormal coloration or soiling, or so-called smudging, on the electron acceptant solid-state acid material coated surface. In order to prevent this, it is commonly practiced to mix in microcapsules a material having a greater particle size than microcapsules as a capsule protective agent (hereinafter referred to as stilt), and generally, fine powder of cellulose, starch granule and various types of plastic beads are used as such stilt.

The starch granules disclosed in Japanese Patent Publication Nos. 1178/72, 33204/73, etc., have fairly good properties in terms of smudging preventive effect, but since specific gravity of starch is large (1.6) in comparison with that of microcapsules (about 1) and also the particle size of starch used for said purpose is usually 20–30 microns, when the coating solution containing such starch is left still, there takes place sedimentation of starch granules to cause a change in composition of the coating solution in a continuous long-time coating operation, resulting in unfavorable variations of quality such as poor development of color on printing on the capsule coated face, smudging, etc. Also, defective color formation occurs when, for instance, taking a large number of copies due to deterioration of color forming performance in printing with weak impressing force owing to said size and hardness of the granules.

On the other hand, fine powder of cellulose, for instance, mechanically and chemically powdered and refined wood pulp, is widely distributed in particle size centering around about 20 microns in width, about 10 microns in thickness and about 100 microns in length, and also the specific gravity of such powdered cellulose is about 1.

Thus, in case finely powdered cellulose is used as stilt, there is no fear of sedimentation of particles in the coating solution because the specific gravity of cellulose powder is substantially equal to that of microcapsules, and therefore there occurs no change in composition nor any variation of quality even in a long-time coating operation. Further, such cellulose particles have proper hardness. Accordingly, when the paper surface is given an intentional pressing force such as applied for printing, there is little possibility that the break of microcapsules be retarded to impede color formation, and thus the paper shows good color forming characteristics even in printing with weak impression force. This type of stilt, however, because of its rod-like shape, proves in some cases unsatisfactory in its smudging preventing effect. Especially in the case of mononucleus microcapsules using amino resin as film material, although they are excellent in water resistance, solvent resistance, etc., the smudging preventive effect by the powder is sometimes found unsatisfactory in the system using cellulose powder.

Also, the top sheet of the system comprising mononucleus microcapsules using amino resin as film material and finely powdered cellulose may present the problem in long-time preservation stability, and the improvement thereof has been required.

Further, the system using said cellulose powder, when applied to the top sheet, may prove unsatisfactory in smoothness of the coated surface, and the improvement on such matter has been also desired.

The present invention has for its object to provide a pressure sensitive copying paper having excellent and well-balanced qualities such as water resistance, solvent resistance, long-time shelf stability, color forming performance, proofness against smudging, and smoothness.

DISCLOSURE OF THE INVENTION

As a result of further studies, the prevent inventors found that the top sheet and intermediate sheet of copying paper excellent in effect of preventing smudging by cellulose powder, color formation and longtime shelf stability can be obtained from a system using rod-shaped fine cellulose powder and mononucleus microcapsules using amino resin as film material, when said microcapsules are chosen to have a volume-average particle diameter of 5–10 microns and a film thickness of $0.08 \propto 0.30$ microns as calculated from the following formula (1):

$$\text{Film thickness } (\mu m) = \frac{DM}{6R}\left\{1 + \frac{(2m_2 - m_3)n}{2m_1}\right\} \quad (1)$$

(wherein D is average particle size (diameter, $\mu$m) of microcapsules, R is the amount (weight parts) of core material, M is the amount (weight parts) of the amino compound used as wall film material, n is the molar ratio of formaldehyde (molecular weight $m_2$) to amino compound (molecular weight $m_1$), and $m_3$ is molecular weight of water).

It was further found that by using the fine powder of cellulose in which 98% or more consists of the fractions with lengths of 100 microns or less, it is possible to attain an improvement of smoothness of the coated surface and a reduction of viscosity of the coating solution to further enhance the utility of the copying paper.

PREFERRED MODES FOR CARRYING OUT THE INVENTION

The finely powdered cellulose particles have a rod-like form measuring about 20 microns in width, about 10 microns in thickness and about 100 microns in length.

The capsules using amino resin as film material have a tendency to mount the cellulose particles due to their relation of electric charges (capsules are positively charged while cellulose is negatively charged), and if the particle size of capsules is too small, the probability of the capsules mounting the cellulose particles is further increased to make the smudging preventive effect of said stilt material unsatisfactory. Conversely, if the particle size of microcapsules is too large, then the capsule particles will become greater in thickness than the cellulose particles and resultantly project out to adversely affect the smudging preventing effect.

As a result of many experiments, the present inventors found that an excellent color forming performance and a high smudging preventive effect are provided by a system using finely powdered cellulose only when the mononucleus microcapsules used are defined to those having a volume-average particle diameter of 5–10 microns. Based on this finding, the present inventors have succeeded in obtaining a pressure sensitive copying paper well-balanced in color forming property and proofness against smudging and having the maximum practically applicability, which copying paper combines the advantages of the system using cellulose powder in being free from sedimentation of particles in the coating solution and hence proof against change in composition in long-time coating operation and minimized in variation of quality while maintaining good color forming property and the advantages of the amino resin film of capsules in being resistant to water and solvents. Thus, it is an essential and characteristic feature for the constitution of this invention that the microcapsules used in the system have a volume-average particle diameter of 5–10 microns.

Another essential structural feature of this invention is that the film thickness of microcapsules as calculated from the above-shown formula (1) should be 0.08–0.30 microns ($\mu$m). These features of the present invention made it possible to obtain a pressure sensitive copying paper having top and intermediate sheets with excellent long-time shelf stability and color forming performance.

Regarding the calculation of film thickness, it was derived from the following formula for film thickness shown in a Japanese text book, Yasunari Kondo: "New Techniques for Encapsulization and Development of Their Uses and Practical Applications", page 104, 'Film Thickness' (published by Keiei Kaihatsu Center, Publishing Department (Japan), in 1978):

$$\text{Film thickness} = \frac{Ww}{W - Ww} \cdot \frac{\rho w}{\rho} \cdot \frac{d}{6}$$

(wherein W is weight of microcapsule, Ww is weight of wall material, $\rho$w is density of wall material, $\rho$ is density of core material, and d is particle diameter of core material).

The above formula is modified by incorporating the following assumptions.

It is assumed that the wall material and the core material are substantially equal to each other in density: $\rho w \approx \rho$.

Since the thickness of wall film is smaller than the particle diameter d of core material or the (average) particle diameter D of microcapsules, it is assumed that $d \approx D$.

Supposing the weight of core material is R, $R = W - Ww$.

Assuming the weight of amino compound used as wall film material is M (molecular weight $m_1$), the molecular weight of formaldehyde is $m_2$, the molar ratio of amino compound (A) used to formaldehyde (F) (F/A) is n, and the molecular weight of water byproduced (condensation water) at the time of film formation is $m_3$, the following equations are given:

$$\text{Weight of formaldehyde} = M \times \frac{m_2}{m_1} \times n$$

$$\text{Weight of water byproduced (condensation water)} = \frac{1}{2}\left(M \times \frac{m_3}{m_1} \times n\right)$$

Weight of wall material = weight of amino compound + weight of formaldehyde − weight of water byproduced (condensation water), that is:

$$Ww = M + M \times \frac{m_2}{m_1} \times n - \frac{1}{2}\left(M \times \frac{m_3}{m_1} \times n\right)$$

Thus, the calculation formula (1) of film thickness can be modified as follows:

$$\text{Film thickness } (\mu m) = \frac{DM}{6R}\left\{1 + \frac{(2m_2 - m_3)n}{2m_1}\right\} \quad (1)$$

The cellulose powder is the one obtained, for instance, by mechanically and chemically pulverizing and refining wood pulp as mentioned before, and the powder particles range from several 10 microns to 100 microns or greater in length. Use of such cellulose powder for the preparation of top and intermediate sheets may present the problems such as poor smoothness to reduce the commercial value of the product. As a result of the studies by the present inventors, it was found that it is insufficient to merely reduce the average size of the particles, and that by excluding the particles with lengths greater than 100 microns, the smoothness can be greatly improved, and the combination of said cellulose powder of said defined particle sizes with microcapsules using amino resin as film material can provide an even more excellent pressure sensitive copying paper, and this finding has added to the usefulness of the invention.

As amino resin used in this invention, there can be cited, for example, urea-formaldehyde resin, melamine-formaldehyde resin, polyurea, and polyurethane. As means for encapsulization, interfacial polymerization, in-situ polymerization method, etc., can be used. Interfacial polymerization method has the defect that it is subject to restrictions on core material, and in-situ polymerization method has greater practical applicability.

These methods are disclosed in Japanese Pat. Publn. Nos. 12380/62, 12518/62 and 16949/79, Japanese Pat. Laid-Open Nos. 66878/77 and 144383/76, etc.

As cellulose powder used in this invention, commercial cellulose powders, for example, KC Flock W-200, W-250 and W-300 produced by Sanyo Kokusaku KK are usable, but more preferably such cellulose powder should be the one in which 98% or more comprises the fractions with lengths less than 100 microns, a typical example of commercial cellulose powder meeting such requirement being KC Flock W-400 available from Sanyo Kokusaku KK. Said cellulose powder is subjected to a dry or wet pulverization treatment and, if necessary, further classified to obtain a suitable preparation.

In the present invention, a known leuco-pigment suited for pressure sensitive recording, for example, a triphenylmethane, diphenylmethane, xanthene, thiazine or spiropyran compounds, can be used as dye in the same way as in the ordinary pressure sensitive copying paper.

Such dye is dissolved or dispersed in a suitable oily solvent, then emulsified into fine droplets in water or a hydrophilic solvent and encapsulized by a suitable encapsulization method such as mentioned above. As oily solvent, nonvolatile solvents of alkylnaphthalene, diallylethane, alkylbiphenyl, hydrogenated terphenyl, ester, etc., can be used.

Further, as electron acceptant material to be contacted with said dye to form a colored image, there are known inorganic color developers such as acidic clay, activated clay, attapulgite, zeolite, etc., phenols, phenol-aldehyde polymer, phenol-acetylene polymer, rosin maleate resin, aromatic carboxylic acids such as salicylic acid and its derivatives, and metal salts of these substances.

Coating of said materials is accomplished at high speed by a coater having a coater head such as air knife, blade, roll or bar.

For more detailed explanation of this invention, examples thereof are described below.

EXAMPLE 1

6 Parts of crystal violet lactone (CVL) was dissolved in 100 parts of KMC-113 (oil for pressure sensitive copying paper, available from Kureha Kagaku KK), and this solution was emulsified with 220 parts of a 5% aqueous solution of styrene-maleic anhydride copolymer (pH 4.5) at 60° C. to obtain an emulsion. Separately, 10 parts of melamine, 19 parts of 37% formalin and 70 parts of water were dissolved under heating by adjusting the pH to 9 with sodium hydroxide to obtain a precondensate. Said emulsion was added thereto and the mixed solution was stirred for one hour with the solution temperature adjusted to 60° C., thereby forming a wall film of melamine-formaldehyde resin around the oil droplets, and the pH was raised to 9.5 with sodium hydroxide to obtain a dispersion of colorless dye-containing mononucleus microcapsules having amino resin film.

The volume-average particle diameter of microcapsules was 6 microns

The film thickness of microcapsules as determined from said calculation formula was 0.15 micron ($\mu$m).

To 100 parts (solid content) of said microcapsule dispersion were added 25 parts of KC Flock W-250 (finely pulverized cellulose powder with 8.7% thereof being the fractions with lengths exceeding 100 microns, produced by Sanyo Kokusaku KK) and 100 parts of a 15% polyvinyl alcohol solution, and they were mixed to prepare a microcapsule coating solution with a solid content of 20%. This solution was coated on a plain paper (fine-quality paper) of 40 g/m$^2$ by an air knife coater at a speed of 100 m/min to a coating weight of 5 g/m$^2$ to obtain a top sheet.

On the other hand, a pressure sensitive copying paper (Mitsubishi NCR Paper "Shita") coated with a novolak type oil-soluble phenolic resin, an electron acceptant material, was provided as the bottom sheet, and said top and bottom sheets were laminated with their coated sides facing each other, and color forming performance, proofness against smudging and other properties of the laminate sheet were examined. The results are shown in Table 1.

EXAMPLE 2

The same procedures as in Example 1 were followed except that the microcapsules had a volume-average particle diameter of 8 microns and that melamine was used in an amount of 11 parts. The results are shown in Table 1.

EXAMPLE 3

The process of Example 2 was repeated but by replacing KC Flock W-250 (8.7% being the fractions with lengths exceeding 100 microns) with KC Flock W-400 (1.0% being the fractions with lengths exceeding 100 microns). The results are shown in Table 1.

EXAMPLE 4

KC Flock W-250 was treated by a jet pulverizer mfd. by Nippon Newmatic KK to reduce the percentage of the fractions exceeding 100 microns in length to 1.5%. By using the obtained pulverized KC Flock W-250, the same operations and examinations as in Example 2 were conducted. The results are shown in Table 1.

EXAMPLE 5

The procedures of Example 1 were followed except that the volume-average particle diameter of microcapsules was defined to 5 microns, and that 6.4 parts of melamine, 12.4 parts of 37% formalin and KC Flock W-400 were used. The results are shown in Table 1.

EXAMPLE 6

The procedures of Example 1 were followed except that the volume-average particle diameter of microcapsules was 10 microns, and that 12 parts of melamine, 23.2 parts of 37% formalin and KC Flock W-400 were used. The results are shown in Table 1.

COMPARATIVE EXAMPLE 1

The procedures of Example 1 were followed except for preparation and use of microcapsules with particle diameter of 4 microns and use of melamine in an amount of 6 parts. The results are shown in Table 1.

COMPARATIVE EXAMPLE 2

The procedures of Example 1 were followed except for 15 micron particle diameter of microcapsules and 12 parts of melamine used. The results are shown in Table 1.

COMPARATIVE EXAMPLE 3

The procedures of Example 2 were followed except that wheat starch was used in place of KC Flock W-250. The results are shown in Table 1.

COMPARATIVE EXAMPLE 4

The procedures of Example 1 were followed except for definition of microcapsule particle diameter to 6 microns and use of melamine in an amount of 3 parts and 37% formalin in an amount of 6.8 parts. The results are shown in Table 1.

COMPARATIVE EXAMPLE 5

The procedures of Example 1 were followed except for definition of microcapsule particle diameter to 8 microns and use of melamine in an amount of 22.5 parts. The results are shown in Table 1.

TABLE 1

| | Capsule | | | Sedimentation in coating solution | Color formation | | Smudging | | Smoothness | Solvent resistance | Heat resistance |
|---|---|---|---|---|---|---|---|---|---|---|---|
| | Particle diameter (μm) | Film thickness (μm) | Stilt | | % | Evaluation | % | Evaluation | | | |
| Example 1 | 6 | 0.15 | KC Flock W-250 | ○ | 68.5 | ○ | 85.0 | ○ | ○ | ○ | ○ |
| Example 2 | 8 | 0.21 | " | | 69.0 | ○ | 84.0 | ○ | ○ | ○ | ○ |
| Example 3 | 8 | 0.21 | KC Flock W-400 | ○ | 67.0 | ○ | 84.5 | ○ | ◎ | ○ | ○ |
| Example 4 | 8 | 0.21 | KC Flock W-250 pulverized | ○ | 67.5 | ○ | 85.0 | ○ | ◎ | ○ | ○ |
| Example 5 | 5 | 0.08 | KC Flock W-400 | ○ | 67.5 | ○ | 83.0 | ○ | ◎ | ○ | ○ |
| Example 6 | 10 | 0.30 | " | ○ | 69.3 | ○ | 83.0 | ○ | | | |
| Comp. Example 1 | <4 | <0.07 | KC Flock W-250 | ○ | 68.5 | ○ | 79.0 | X | ◎ | Δ | X |
| Comp. Example 2 | >15 | >0.42 | " | ○ | 67.0 | ○ | 78.5 | X | ○ | ○ | ○ |
| Comp. Example 3 | 8 | 0.21 | Wheat starch | X | 72.0 | X | 85.0 | ○ | ○ | ○ | ○ |
| Comp. Example 4 | 6 | 0.06 | KC Flock W-250 | ○ | 65.0 | ○ | 78.5 | X | | Δ | X |
| Comp. Example 5 | 8 | 0.37 | " | ○ | 78.0 | X | 86.0 | ○ | ○ | ○ | ○ |

(1) Capsule

Particle diameter of capsules is the volume-average particle diameter measured by Coulter Counter (trade name of a particle diameter measuring device manufactured by Coulter Counter Inc., U.S.), and film thickness is the calculation value obtained from the above-shown calculation formula (1).

(2) Sedimentation in coating solution

The state of sedimentation of cellulose powder or wheat starch after the capsule coating solution was left as it was for a day. ○: no sediment. X: much sediment.

(3) Color formation

Indicated by the percentage of developed color density (reflectance, %) to base density (reflectance, %) in typewriter printing. The smaller the figure, the higher is the density ○: good. X: bad.

(4) Smudging

Index of smearing, indicated by the percentage of density (reflectance, %) at the friction-smudged portion to density (reflectance, %) at the base portion. The greater the figure, the less is the degree of smudging. ○: good. X: bad.

(5) Smoothness

The feel of the capsule coated surface when touched with the hand. ◎: very good. ○: good.

(6) Solvent resistance

Indicated by the degree of break of capsules by toluene. ○: good, with no break. Δ: showing a tendency to break.

(7) Heat resistance

Indicated by the degree of break of capsules after the laminate of top and bottom sheets was heated at 140° C. for 3 hours. ○: good, with no break. X: bad.

As apparent from Table 1, with a system using fine powder of cellulose, there could be obtained a pressure sensitive copying paper proof against smudging, having excellent color forming performance on printing, combining the advantage of cellulose powder in being minimized in sedimentation in coating solution and hence little changed in composition in long-time coating operation and the advantage of microcapsules using amino resin as film material in having excellent water and solvent resistance, and also excellent in long-time storage stability, only when the particle diameter of the mononucleus microcapsules using amino resin as film material was defined to 5–10 microns and the capsule film thickness to 0.08–0.30 microns (μm).

Further, by using the cellulose powder prepared such that 98% by weight or more is the fractions of 100 microns or below in length, there could be obtained a pressure sensitive copying paper having even better smoothness.

What is claimed is:

1. A pressure sensitive copying paper comprising a sheet having on a support a coating layer containing finely divided cellulose powder (a) and microcapsules of mononucleus (b) containing an oily solution of an electron donative colorless or light-colored dye, using an amino resin as film material and having a volume-average particle diameter of 5–10 microns (μm) and a film thickness of 0.08–0.30 microns (μm) as calculated from the formula (1):

$$\text{Film thickness } (\mu m) = \frac{DM}{6R}\left(1 + \frac{(2m_2 - m_3)n}{2m_1}\right) \quad (1)$$

(wherein D is average particle size (diameter, μm) of microcapsules, R is the amount (weight parts) of core material used, M is the amount (weight parts) of amino compound used as wall film material, n is the molar ratio of formaldehyde used (molecular weight $m_2$) to amino compound (molecular weight $m_1$), and $m_3$ is molecular weight of water); and a sheet having on a support a coating layer containing an electron acceptant solid-state acid material which is reacted on contact with said dye to form a color.

2. The pressure sensitive copying paper according to claim 1, wherein the cellulose powder (a) is the one in which 98% by weight or more comprises the fractions with lengths of 100 microns (μm) or less.

* * * * *